United States Patent [19]

Lewanoni

[11] 4,212,132

[45] Jul. 15, 1980

[54] DOLL WITH EMBRACING ARM MOVEMENT

[75] Inventor: Dov Lewanoni, Brooklyn, N.Y.

[73] Assignee: Goldberger Doll Mfg. Co., Inc., Brooklyn, N.Y.

[21] Appl. No.: 921,320

[22] Filed: Jul. 3, 1978

[51] Int. Cl.[2] ..... A63H 5/00

[52] U.S. Cl. ..... 46/118; 46/119; 46/175 R

[58] Field of Search ..... 46/118, 119, 128, 148, 46/142, 173, 178, 179, 175 R

[56] References Cited

U.S. PATENT DOCUMENTS 1,691,443 11/1928 Lloyd ..... 46/118

*Primary Examiner*—Houston S. Bell

*Attorney, Agent, or Firm*—Kirschstein, Kirschstein, Ottinger & Cobrin

[57] ABSTRACT

A doll with embracing arms and concomitant clapping hands movement. The structure features a guided movable panel in the torso of the doll which, when the doll torso is squeezed, moves to a depressed position within a receptacle within the torso so that the arms of the doll pivot about individual pivotal mountings, i.e., each of the arms is partially rotatable about a substantially vertical axis, so that the arms move towards each other as if the doll were embracing the child playing with the doll. An air actuated sound-generating member is preferably centrally mounted to the movable panel below leg panels which guide the movement of the movable panel into and out of the receptacle, and a bellows extends within the lower part of the receptacle between the sound-generating member and the rear side of the receptacle, so that when the movable panel is depressed, i.e., when the doll is squeezed by the child, the bellows forces air through the member and a cooing sound emanates from the member, i.e., from within the doll, concomitantly with the embracing movement of the arms.

9 Claims, 9 Drawing Figures

DOLL WITH EMBRACING ARM MOVEMENT

BACKGROUND OF THE INVENTION

1. Field of the Invention

A doll with embracing arm movement, which doll also preferably is an audible sound emitting doll.

2. Description of the Prior Art

Dolls which provide discretionary movement of the limbs and which emit audible sounds provide a great deal of enjoyment for children, because of the simulation of a real-life baby or infant, person or character of fiction to which the child can readily relate.

In British Pat. No. 871,728, a pair of arms are pivotally interconnected with a sounding mechanism between them, so that when they are squeezed together, the sounding mechanism is actuated. The two arms are also connected to levers, which are swung forwardly upon squeezing of the arms. The levers are contained within the arms of a soft bodied doll so that upon squeezing the doll from front to back, the arms of the doll are moved forwardly, turning about horizontal axes. Since the arms are moved about horizontal axes rather than about vertical axes, no clasping or embracing movement of the doll arms results.

Canadian Pat. No. 642,120 also has a sounder and here, too, the arms are caused to turn about horizontal axes as a sound is made.

A clasping motion is disclosed in U.S. Pat. Nos. 3,125,828 and 3,928,933. Although these patents show a motion of the arms about vertical axes at the shoulder, the type of structure employed for this purpose is clearly different from that of the present invention, as will appear infra. U.S. Pat. No. 3,376,665 illustrates another arrangement where a sounder is combined with a different motion, in this case being the head. French Pat. No. 1,159,316 is similar to the last-mentioned U.S. Patent in that it, too, illustrates the use of a sounder in conjunction with a head part, namely the lips. Another pertinent reference is U.S. Pat. No. 3,053,008.

A simple form of toy which emits an audible sound is one in which a sound is emitted when the toy is squeezed, in which case air is forced through means such as a whistle mounted in the body of the toy. Prior art relating to such pneumatic toys includes U.S. Pat. Nos. 2,616,217; 2,712,201; 2,745,214; 2,819,558; 2,928,208; and 3,075,317; British Pat. No. 814,021; and French Pat. Nos. 1,031,489; 1,038,887 and 1,171,083.

Other toys rely on the winding of a spring-motor, e.g., by the turning of a key or by the pulling of a string, cord or wire by the child, to wind up and/or actuate the sound-producing unit which is usually a toy phonograph within the body of the toy. Prior art of this nature includes U.S. Pat. Nos. 3,165,320; 3,261,124; 3,282,588; 3,298,130; 3,315,406; 3,600,848; 3,636,654; 3,636,655 and 3,859,749; and French Pat. No. 1,104,910.

More sophisticated devices have been recently developed in which an electrically operated unit is installed in the toy to emit a sound. Usually the unit is battery-operated and the sound is emitted by throwing a switch. Prior art relative to such a unit includes U.S. Pat. Nos. 3,467,393 and 3,589,735 and Japanese Pat. No. 793,915.

SUMMARY OF THE INVENTION

Purposes of the Invention

It is an object of the present invention to provide an improved doll with embracing arm movement.

Another object is to provide a doll with embracing arm movement which also concomitantly emits an audible sound when the arms move.

A further object is to provide a doll which, when the torso is squeezed from front to back, provides displacement of internal members such that the arms pivot about vertical axes in an embracing or clasping movement.

An additional object is to provide a doll with embracing arm movement having an improved internal structure to provide such movement when the doll torso is squeezed from front to back.

Still another object is to provide a doll with embracing arm movement which is less costly and more rugged and reliable in service than prior art dolls of this nature.

Still a further object is to provide a doll with embracing arm movement which is easily assembled and manufactured from components which are readily and cheaply fabricated.

These and other objects and advantages of the present invention will become evident from the description which follows.

Brief Description of the Invention

In the present invention, a doll with embracing arms and concomitant clapping hands movement is provided which includes a torso, the torso being hollow, two legs dependent from the torso, a head which is mounted on the upper end of the torso and two arms. Each of the arms is pivotally mounted on one side of the upper end of the torso. Each arm is partially rotatable about a generally vertical axis and has a rigid extension into the torso beyond the pivotal mounting. Manually displaceable means are provided within the torso. This means, when displaced, serves to move the rigid extensions such that the arms pivot about their pivotal mountings and move toward each other in an embracing arms and concomitant clapping hands movement. This structure and means is preferably combined with an airactuated sound-generating member which is mounted to the means, and a bellows. The bellows extends from the member to a wall of the torso, so that when the aforementioned means is displaced, the bellows is compressed and air is forced through the member, so that a sound such as cooing emanates from within the torso. The longitudinal axis of the bellows is oriented so as to be coincident with the direction of movement of the means.

In one specific embodiment of the invention, the aforementioned means includes a rectangular parallelepiped receptacle which is longitudinally disposed within the torso and has an open front side. Each of the pivotal mountings of the arms is attached to the receptacle and is disposed external to one side edge of the receptacle proximately at the top of the receptacle. A movable panel is also part of the aforementioned means. The movable panel has dependent leg panels which slidably engage the interior of the side walls of the receptacle. A protuberance on the surface of each leg panel extends into a rectilinear slot in a side wall of the receptacle. Each of the slots is generally perpendicular to the rear side of the receptacle, so that when the movable panel is depressed, each of the protuberances slides in a slot and the movable panel moves from a spaced away position parallel to the rear side of the receptacle, to a displaced position closer to and parallel to the rear side of the receptacle. A pair of lever arms are provided; each of the lever arms extends into the receptacle from the pivotal mounting of one of the arms, so that displacement of a lever arm when the movable panel is depressed pivots the arm of the doll about the pivotal mounting. A flexible resilient connection member under tension extends rectilinearly between the pair of lever arms. Finally, contact means are provided at each upper corner of the movable panel. Each contact means contacts and displaces one of the lever arms when the movable panel is depressed and displaced into the receptacle, so that the arms move towards each other in an embracing movement and the hands on the terminal ends of the arms appear to clap.

In a preferred embodiment, the movable panel is provided with a central protuberance which extends outwards from the movable panel. Preferably, the protuberance is a convex curved bulge in the surface of the movable panel, i.e., the protuberance is dome-shaped.

Typically, the flexible resilient connection member is a rubber band, composes of natural and/or synthetic rubber such as neoprene or buna-S. However, the member may alternatively be a metallic spring or may be composed of a resilient synthetic plastic.

In the specific embodiment of the invention described supra, this embodiment is preferably combined with the aforementioned air actuated sound-generating member which is centrally mounted to the movable panel below the leg panels. The bellows extends within the lower part of the receptacle between the member and the rear side of the receptacle, so that when the movable panel is depressed, the bellows forces air through the member and a sound emanates from the member. The sound preferably simulates the sound of the voice of a baby cooing.

Typically, the terminal end of each lever arm is generally circular, and the flexible resilient connection member extends between and through opposed holes in the terminal end of each lever arm.

In a preferred embodiment, the aforementioned specific embodiment is combined with a guide pin which is mounted to the center of the front of a top panel of the receptacle and which extends generally perpendicularly to the movable panel. The movable panel is provided with an opening, with the guide pin extending into the opening in the movable panel except when the movable panel is depressed, so that the guide pin guides the travel of the movable panel, when the movable panel is manually depressed towards a displaced position. Preferably, the terminal end of the guide pin is provided with an outer lip.

The present doll with embracing arm movement provides several salient advantages. The doll has an improved embracing arm movement, which is more life-like and effectively simulates the embracing arm motion of a real-life baby or infant, person or character of fiction, to which the child can readily relate. Typically, the doll also concomitantly emits an audible sound, e.g., cooing, when the arms move, so as to further enhance the simulation of a real-life child, baby or infant, or other human being. When the hollow torso is squeezed from front to back, the doll provides displacement of internal members, such that the arms pivot about vertical axes which effectively simulates a real-life embracing or clasping movement. Thus the child playing with the doll imagines that the doll is a real baby or infant who loves the child and seeks to embrace the child, i.e., the present arm movement makes the child feel that the doll wants the child, and thus fulfills a basic desire to be wanted found in all humans. The improved internal structure provides such movement when the doll torso is squeezed from front to back. The present doll and its new and embracing arm movement and structure is less costly and more rugged and reliable in service than prior art dolls of this nature. The present doll is easily assembled and manufactured from components which are readily and cheaply manufactured and fabricated.

The invention accordingly consists in the features of construction, combination of elements and arrangement of parts, which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figures 1, 2, 3:
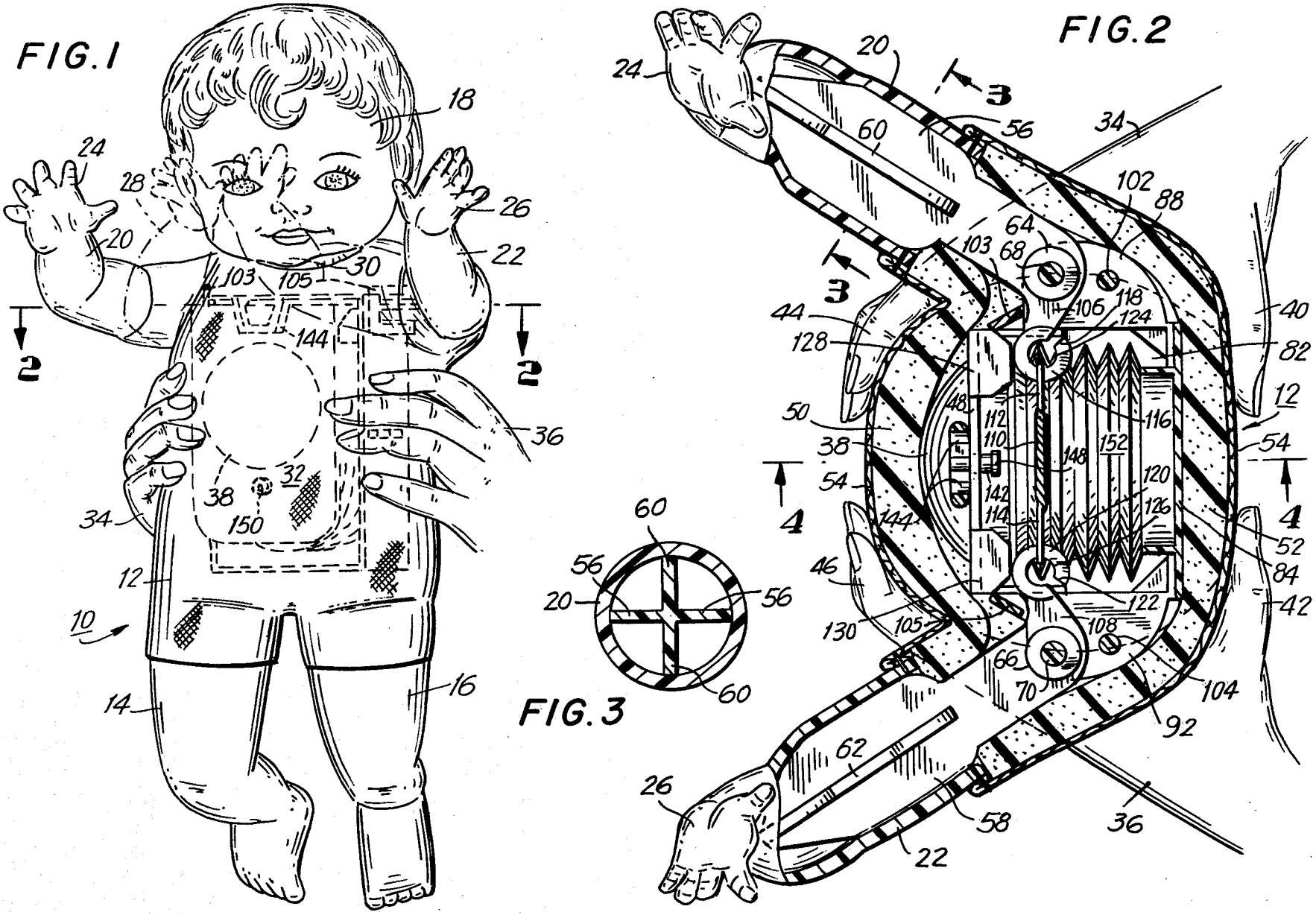
FIG. 1 is an elevation view of the present doll.
FIG. 2 is a sectional plan view taken substantially along the line 2—2 of FIG. 1.
FIG. 3 is a partial sectional elevation view taken substantially along the line 3—3 of FIG. 2.

Referring now to FIG. 1, the doll 10 of the present invention is characterized by the provision of a hollow torso 12 shown covered with a garment, two legs 14 and 16 which depend from the torso 12, a head 18 mounted on the upper end of the torso 12, and two arms 20 and 22 each provided with a respective hand 24 and 26. As will appear infra, each of the arms 20 and 22 is pivotally mounted on one side of the upper end of the torso 12, so that each of the arms 20 and 22 is partially rotatable about a substantially vertical axis proximately at a shoulder of the doll 10. The resultant clasping or embracing movement takes place as the arms 20 and 22 move to a displaced position shown in respective phantom outlines 28 and 30, with the hands 24 and 26 in the phantom disposition being contiguous. FIG. 1 also shows, in phantom outline, the manually displaceable means generally designated as 32 within the hollow torso 12. Finally, FIG. 1 shows the hands 34 and 36 in position grasping the doll, and then the fingers of the hands 34 and 36 extend over the dome-shaped protuberance 38, as will appear infra, the displaceable means is manually displaceable at will from front to back by squeezing the doll, so that the arms 20 and 22 are moved to the respective positions 28 and 30 shown in phantom outline.

Referring now to FIGS. 2–6, inclusive, the hands 34 and 36 are emplaced about the torso 12 and grasp the torso 12 with the respective thumbs 40 and 42 in contact with the rear of the torso 12 and the balance of the fingers, respectively 44 and 46, in place over the front of the torso and in particular over the dome-shaped protuberance 38, which is a central convex curved bulge in the surface of a movable panel 48, and which extends outwards from the surface of the movable panel 48. The panel 48 is an integral part of the means 32 mentioned supra. The means 32 is mounted in the hollow torso 12 between the respective front and rear foamed plastic linings 50 and 52, which in turn are contained within the outer cloth skin 54 of the doll.

The arms 20 and 22 are hollow flexible resilient plastic members each having a respective internal rigid flat plastic support member 56 and 58, and a respective transverse rigid flat plastic member 60 and 62 for added support in the arms 20 and 22 respectively of the flexible resilient plastic skin members. The support members 56 and 58 extend to respective pivotal mountings 64 and 66, each of which has a respective generally vertical axle 68 and 70, so that each of the arms 20 and 22 is pivotally mounted on one side of the upper end of the torso 12, such that each of the arms 20 and 22 is partially rotatable about a generally vertical axis, i.e., the central longitudinal axis of the respective axle 68 and 70.

Figure 5:
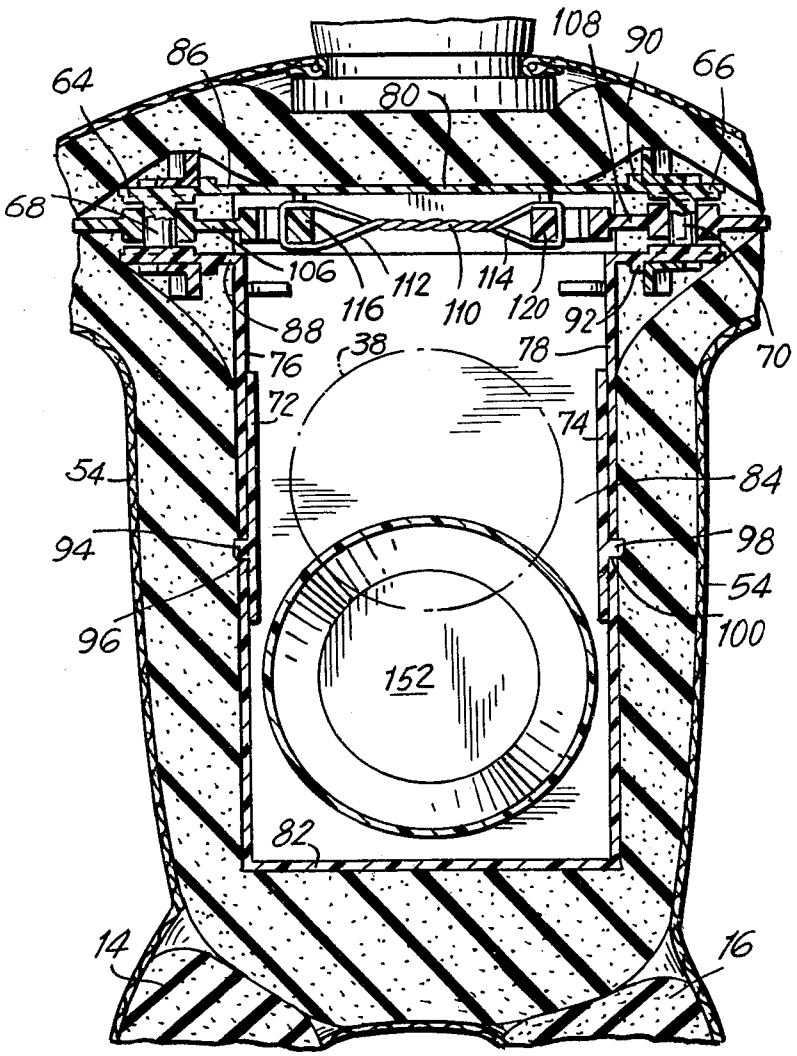
FIG. 5 is a partial sectional elevation view taken substantially along the line 5—5 of FIG. 4.
Figure 4:
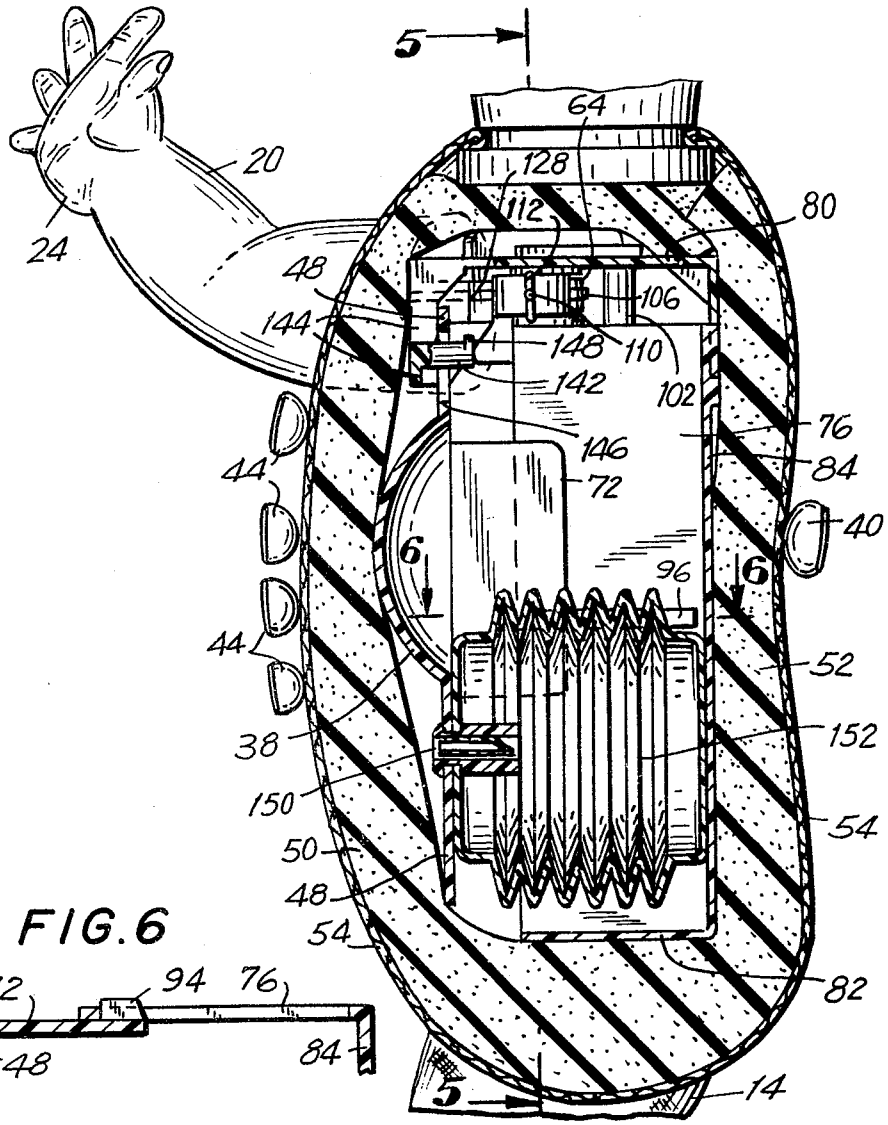
FIG. 4 is a partial sectional elevation view taken substantially along the line 4—4 of FIG. 2.

Referring now to the internals of the torso 12, the movable panel 48 has dependent leg panels 72 and 74 which slidably engage the interior of the side walls 76 and 78 of an internal receptacle within the torso 12, as best shown in FIG. 5. The internal receptacle also has a top wall 80, a bottom wall 82, and a rear wall 84 (FIG. 4). The pivotal mountings 64 and 66 of the respective arms 20 and 22 are attached to the receptacle, each pivotal mounting 64 or 66 being disposed external to one side edge 76 or 78 of the receptacle proximately at the top of the receptacle. The actual mounting consists, relative to pivotal mounting 64, of extensions 86 and 88 of the respective top edge 80 and side edge 76 of the receptacle; and, relative to pivotal mounting 66, of extensions 90 and 92 of the respective top edge 80 and side edge 78 of the receptacle.

Figure 6:
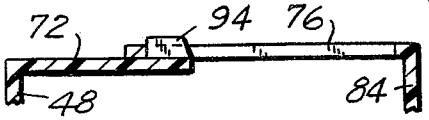
FIG. 6 is a partial sectional plan view taken substantially along the line 6—6 of FIG. 4 and showing a detail of the doll.
Figure 8:
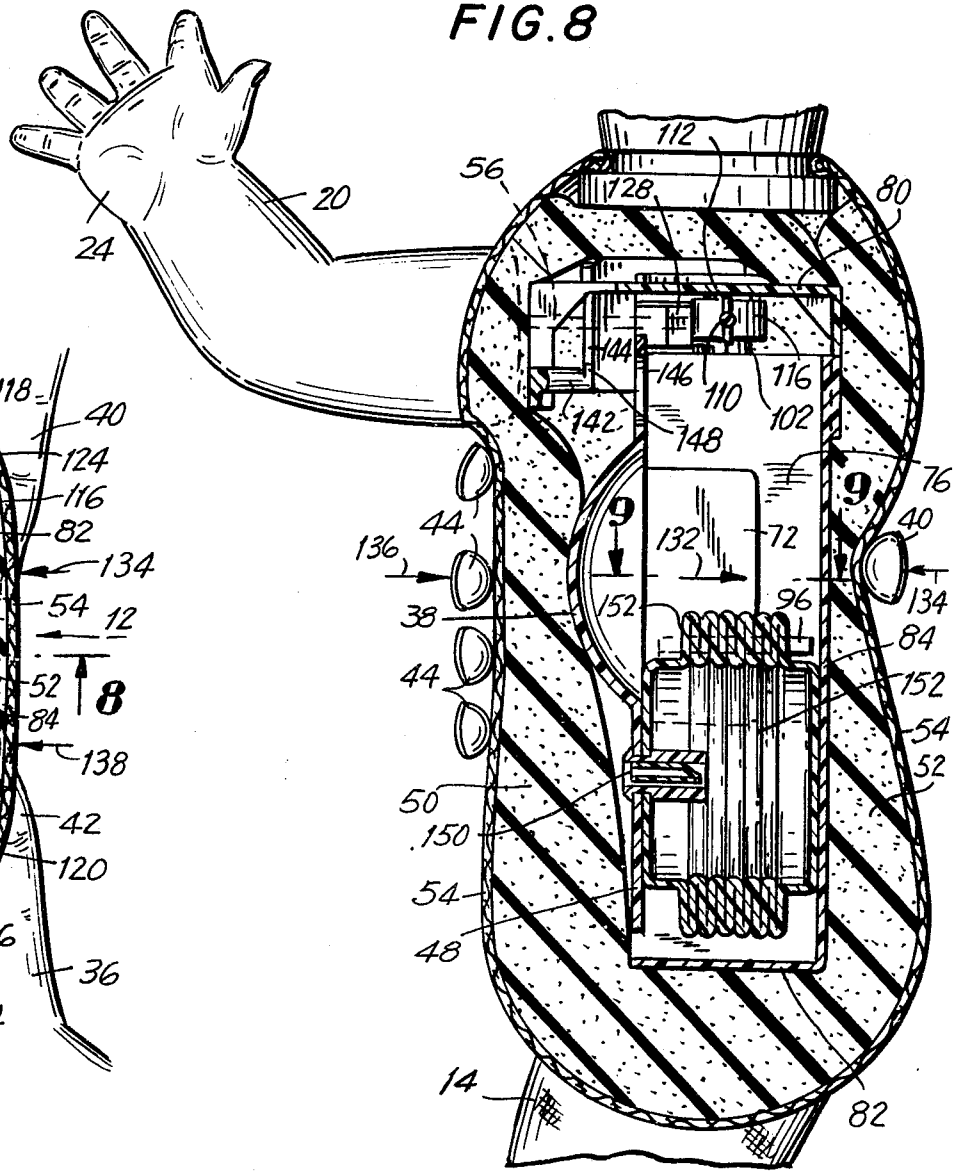
FIG. 8 is a partial sectional elevation view taken substantially along the line 8—8 of FIG. 7.

Referring now to FIGS. 4 and 6, a protuberance 94 on the surface of the leg panel 72 extends into a rectilinear slot 96 in the side wall 76 of the receptacle. FIG. 5 shows an opposite protuberance 98 on the surface of leg panel 74 extending into a rectilinear slot 100 in the side wall 78 of the receptacle. Each of the slots 96 and 100 are generally perpendicular to the rear side 84 of the receptacle (see FIG. 4), so that when the movable panel 48 is depressed, each of the protuberances 94, 98 slides in a respective slot 96, 100, and the movable panel moves, as will appear infra, from a spaced away position (as shown in FIG. 4) parallel to the rear side 84 of the receptacle, to a displaced position (as shown in FIG. 8) closer to and parallel to the rear side 84 of the receptacle.

Extensions 86 and 88 are connected by support pin 102, and extensions 90 and 92 are connected by support pin 104. The pins 102 and 104 extend between the respective extensions so as to provide rigidity to the assemblage and to protect the extensions against breakage away from the respective receptacle portions, especially as the doll is squeezed and the doll arms 20 and 22 partially rotate about their respective pivotal mountings 64 and 66. The pins 102, 104 also serve as stops to prevent excessive inward movement of the respective arms 20, 22 by contacting and restraining the lever arms 106, 108 to be described infra, as the arms 20, 22 pivot and move towards each other when the movable panel 48 is depressed. The saddles 103, 105 on the opposite side of the lever arms 106, 108 and extending between extensions 86, 88 and 90, 92 are also provided to prevent excessive inward movement of the respective arms 20, 22 by contacting and restraining members 56, 58, as the arms 20, 22 pivot and move towards each other when the movable panel 48 is depressed. Thus, the inward movement of the arms 20, 22 towards each other is controlled. The prevention of excessive inward movement of the arms 20, 22 also concomitantly controls and prevents excessive downwards motion of the movable panel 48, since the structures are in contact when the movable panel 48 is depressed, via protuberances 128, 130 contacting and bearing against terminal ends 116, 120 as will appear infra. Saddles 103, 105 also act as strengthening members for the extensions 86, 88 and 90, 92.

A pair of lever arms 106 and 108 are provided. Each lever arm 106, 108 extends into the receptacle just below top wall 80 from a respective pivotal mounting 64, 66, with each lever arm 106, 108 essentially being an extension of the respective support member 56 or 58. Hence, displacement of a lever arm 106, 108, when the movable panel 48 is depressed, pivots the respective arm 20, 22 of the doll about its respective pivotal mounting 64, 66.

A flexible resilient connection member, consisting in this case of a rubber band having a central twisted section 110 and lateral loops 112 and 114, is under tension and extends rectilinearly between the pair of lever arms 106 and 108, with the terminal loop 112 being looped about the generally circular terminal end 116 of the lever arm 106 via slot 118, and with the terminal loop 114 being looped about the generally circular terminal end 120 of the lever arm 108 via slot 122, so that the flexible resilient connection member consisting of rubber band 110, 112, 114 extends between and through opposed holes 124 and 126 in the respective circular terminal ends 116, 120 of the lever arms 106, 108.

Contact means consisting of protuberances 128, 130 extend inwards into the receptacle from the upper front corners of movable front panel 48. Each of the protuberances 128, 130 contacts and bears against the respective terminal end 116, 120 of a lever arm 106, 108, so that when the movable panel 48 is depressed and displaced into the receptacle, each protuberance 128, 130 cams and displaces the respective terminal end 116, 120, so that the lever arms 106, 108 are thus displaced such that the arms 20, 22 move towards each other in an embracing movement, and the hands 24 and 26 appear to clap (see FIG. 7). The movement arrow 132 (FIGS. 7 and 8) indicates the direction of movement of the movable panel 48 when the doll is squeezed from front to back by pressure and movement of the respective fingers 40, 44 in the directions indicated by the respective arrows 134, 136 (FIGS. 7 and 8), and pressure and movement of the respective fingers 42, 46 in the directions indicated by the respective arrows 138, 140. Thus the FIGS. 7 and 8 show the disposition of the elements when the movable panel 48 is displaced into the receptacle.

Figure 7:
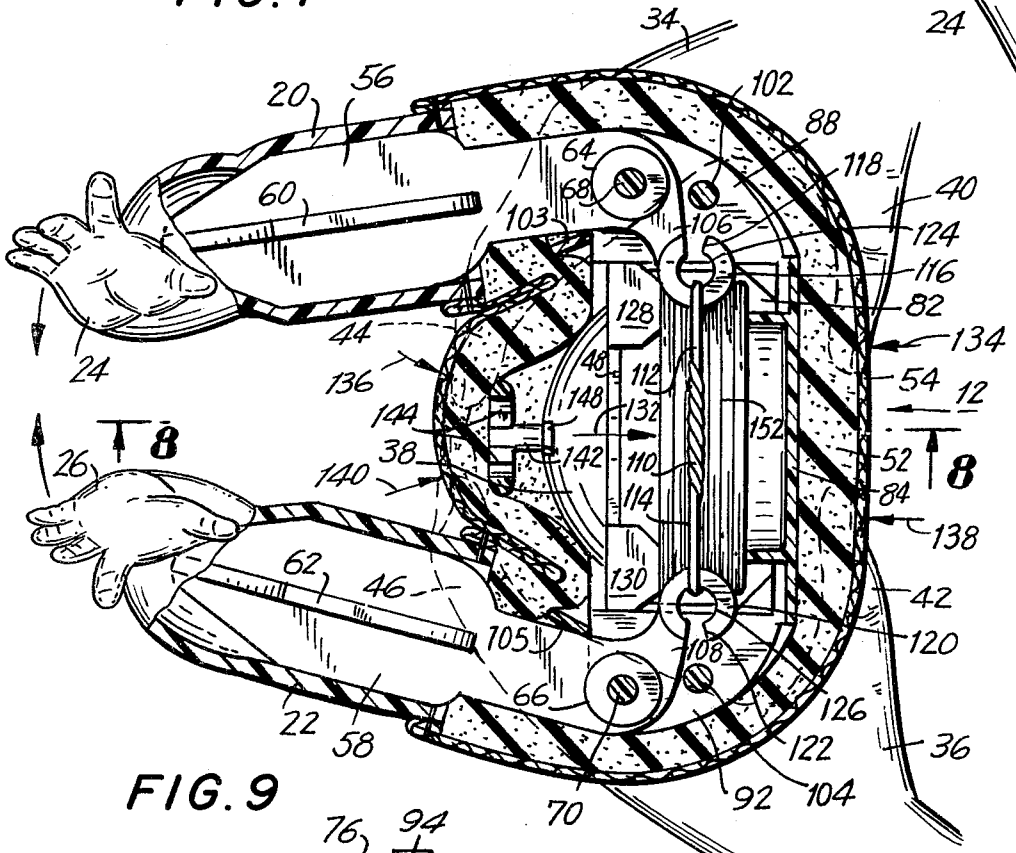
FIG. 7 is a sectional plan view similar to FIG. 2 but showing the configuration and disposition of elements when the doll is squeezed from front to back.
Figure 9:
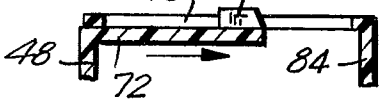
FIG. 9 is a partial sectional plan view taken substantially along the line 9—9 of FIG. 8 and showing a detail of the doll.

The movement of the movable panel 48 to a displaced position as shown in FIGS. 7 and 8 is guided by the provision of a guide pin 142 which is mounted to the center of the front of the top panel 80 of the receptacle and which extends substantially perpendicular to the movable panel 48. The pin 142 is attached to and mounted on a frame 144 which is attached to and extends downwards from the top panel 80. In addition, the movable panel 48 is provided with an upper central opening 146. As shown, the guide pin 142 extends into the opening 146 in the movable panel 48 except when the movable panel 48 is depressed (FIGS. 7 and 8), so that the guide pin 142 guides the travel of the movable panel 48 when the movable panel 48 is depressed towards a displaced position (FIGS. 7 and 8). Preferably, the terminal end of the guide pin 142 is provided with an outer lip 148 over at least part of its peripheral surface, to furnish added strength against inadvertent contact of the pin 142 with the movable panel 48, which could cause breakage or wear of the terminal end of the pin 142. In this preferred embodiment of the invention, the lip 148 extends over only the upper half of the terminal end of the pin 142. The frame 144 also prevents excessive outwards movement of the movable panel 48. Such a tendency could occur if a child playing with the doll attempts to spread the arms 20, 22 further away than their normal disposition, in which case the circular terminal members 116, 120 would exert force against protuberances 128, 130 and concomitantly against the movable panel 48.

Comparing FIGS. 2 and 7, it is evident that when the arms 20, 22 are close to each other as in FIG. 7, the rubber band 110, 112,114 is elongated and additionally stressed compared to the FIG. 2 disposition. Thus, when the elements are in the FIG. 7 orientation, there is a force exerted by the rubber band 110, 112, 114 against the ends 116, 120 which tends to pivot the arms 20, 22 to the FIG. 2 disposition. This tendency is restrained and no pivoting occurs as long as force is exerted against the movable panel 48 to hold in the displaced position of FIG. 7, since in this case as mentioned supra the respective protuberances 128, 130 are pressing against the terminal ends 116, 120 and thus the arms 20, 22 are held in the FIG. 7 disposition. As soon as this force on the panel 48 is relieved, i.e., when the doll is no longer squeezed, the arms 20, 22 spring back to their original orientation of FIG. 2, and concomitantly the movable panel 48 moves to the FIG. 2 disposition since ends 116, 120 exert a displacement force against protuberances 128, 130. In addition, the bellows 152 acts in a similar manner to move the lower portion of the panel 48 away from the receptacle when the force on panel 48 is relieved, so that the panel 48 in toto moves outwards to the FIG. 2 orientation.

The doll is completed in this preferred embodiment of the invention by the provision of an air-actuated sound generating member, i.e., a whistle 150, which is mounted to the manually displaceable means 32 and more specifically to the movable panel 48, and a bellows 152. The bellows extends from the panel 48, i.e., from the whistle 150, to the rear wall 84 of the torso 12, as best shown in FIG. 4, so that when the means 32 is displaced, i.e., when the panel 48 is depressed, the bellows 152 is compressed as shown in FIGS. 7 and 8 and air is forced through the whistle 150 so that a sound emanates from within the torso 12, e.g., the sound of a baby cooing. The longitudinal axis of the bellows 152 is generally coincident with the direction of movement of the means 32, specifically the direction of movement of the movable panel 48 and dependent leg panels 72, 74 when depressed.

Thus, the air-actuated sound generating member consisting in this embodiment of the whistle 150 is centrally mounted to the movable panel 48 below the leg panels 72, 74 and the bellows 152 extends within the lower part of the receptacle between the whistle 150 and the rear side wall 84 of the receptacle, so that when the movable panel 48 is depressed, the bellows 152 forces air through the whistle 150 and a sound emanates from the whistle 150.

It thus will be seen that there is provided a doll with embracing arm movement which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A doll with embracing arms and concomitant clapping hands movement which comprises a torso, two legs dependent from said torso, a head, said head being mounted on the upper end of said torso, and two arms, each of said arms being pivotally mounted on one side of the upper end of said torso so that each of said arms is partially rotatable about a substantially vertical axis, a rectangular parallelepiped receptacle, said receptacle being longitudinally disposed within said torso and having an open front side, each of the pivotal mountings of said arms being attached to said receptacle and being disposed external to one side edge of said receptacle proximately at the top of said receptacle, a movable panel, said movable panel having dependent leg panels which slidably engage the interior of the side walls of said receptacle, with a protuberance on the surface of each leg panel extending into a rectilinear slot in a side wall of said receptacle, each of said slots being substantially perpendicular to the rear side of said receptacle so that when said movable panel is depressed, each of said protuberances slides in a slot and said movable panel moves from a spaced away position parallel to the rear side of said receptacle to a displaced position closer to and parallel to the rear side of said receptacle, a pair of lever arms, each of said lever arms extending into said receptacle from the pivotal mounting of one of said arms, so that displacement of a lever arm when said movable panel is depressed pivots the arm of the doll about said pivotal mounting, a flexible resilient connection member, said connection member being under tension and extending rectilinearly between said pair of lever arms, and contact means at each upper corner of said movable panel, each contact means contacting and displacing one of said lever arms when said movable panel is depressed and displaced into said receptacle, so that said arms move towards each other in an embracing movement and the hands on the terminal ends of said arms appear to clap.

2. The doll of claim 1 in which the movable panel is provided with a central protuberance, said protuberance extending outwards from the movable panel.

3. The doll of claim 2 in which the protuberance is a convex curved bulge in the surface of the movable panel.

4. The doll of claim 1 in which the flexible resilient connection member is a rubber band.

5. The doll of claim 1 in which an air actuated sound-generating member is centrally mounted to the movable panel below the leg panels, and a bellows extends within the lower part of the receptacle between said member and the rear side of the receptacle, so that when the movable panel is depressed, said bellows forces air through said member and a sound emanates from said member.

6. The doll of claim 5 in which the sound which emanates from the member simulates the sound of the voice of a baby cooing.

7. The doll of claim 1 in which the terminal end of each lever arm is substantially circular and the flexible resilient connection member extends between and through opposed holes in the terminal end of each lever arm.

8. The doll of claim 1 together with a guide pin, said guide pin being mounted to the center of the front of a top panel of the receptacle and extending substantially perpendicularly to the movable panel, the movable panel being provided with an opening, said guide pin extending into the opening in the movable panel except when the movable panel is depressed, so that said guide pin guides the travel of the movable panel when the movable panel is depressed towards a displaced position.

9. The doll of claim 8 in which the terminal end of the guide pin is provided with an outer lip.

* * * * *